US010779648B2

(12) United States Patent
Lucas et al.

(10) Patent No.: US 10,779,648 B2
(45) Date of Patent: Sep. 22, 2020

(54) CONNECTION DEVICE AND ITEM OF FURNITURE OR DOMESTIC APPLIANCE

(71) Applicant: Grass GmbH, Hoechst (AT)

(72) Inventors: Tim Lucas, Leinfelden-Echterdingen (DE); Gabriel Auer, Maeder (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 16/209,156

(22) Filed: Dec. 4, 2018

(65) Prior Publication Data

US 2019/0239643 A1 Aug. 8, 2019

(30) Foreign Application Priority Data

Dec. 4, 2017 (DE) ..... 10 2017 128 746

(51) Int. Cl.
*A47B 88/407* (2017.01)
*A47B 88/493* (2017.01)
*A47B 88/427* (2017.01)

(52) U.S. Cl.
CPC ..... *A47B 88/407* (2017.01); *A47B 88/427* (2017.01); *A47B 88/493* (2017.01);
(Continued)

(58) Field of Classification Search
CPC .... A47B 88/407; A47B 88/427; A47B 88/493
(Continued)

(56) References Cited

U.S. PATENT DOCUMENTS 5,439,283 A * 8/1995 Schroder ..... A47B 88/407 312/334.38
5,588,729 A * 12/1996 Berger ..... A47B 88/427 312/330.1

(Continued)

FOREIGN PATENT DOCUMENTS

CN 107224124 A 10/2017
DE 295 06 930 U1 10/1995

(Continued)

OTHER PUBLICATIONS

German Search Report (Application No. 10 2017 128 746.9) dated Oct. 16, 2018.

(Continued)

*Primary Examiner* — James O Hansen
(74) *Attorney, Agent, or Firm* — Burr & Brown, PLLC

(57) ABSTRACT

A device for connecting a movable sliding element to a guide rail of a guide system of an item of furniture having adjustment means comprising latching means, an operating element, and a height adjustment element. The latching means have latching teeth and a latching member. The latching teeth are disposed along a shell face. The latching member is connected to the operating element and the latching member latches with the latching teeth. The height adjustment element is configured in the manner of a disk and the height adjustment element is present so as to be pivotable. The operating element is connected to the height adjustment element. The device in the disposed state connects the sliding element to the guide rail in such a manner that a positional modification of the height adjustment element causes a positional modification of the sliding element relative to the guide system.

13 Claims, 8 Drawing Sheets

(52) U.S. Cl.
CPC ..... *A47B 2088/4272* (2017.01); *A47B 2088/4276* (2017.01); *A47B 2210/0002* (2013.01); *A47B 2210/0054* (2013.01)

(58) Field of Classification Search
USPC ..... 312/330.1, 334.1, 334.4, 334.5
See application file for complete search history.

(56) References Cited

U.S. PATENT DOCUMENTS

| | | | | |
|---|---|---|---|---|
| 9,095,211 | B2 | 8/2015 | Amann et al. | |
| 9,907,399 | B2 | 3/2018 | Lucas | |
| 2014/0210330 | A1 | 7/2014 | Amann et al. | |
| 2015/0366346 | A1 | 12/2015 | Raid et al. | |
| 2016/0227927 | A1* | 8/2016 | Goetz ..... | A47B 88/407 |
| 2017/0095081 | A1 | 4/2017 | Lucas | |
| 2017/0095082 | A1 | 4/2017 | Lucas | |

FOREIGN PATENT DOCUMENTS

| | | | |
|---|---|---|---|
| DE | 20 2011 104 673 | U1 | 1/2013 |
| DE | 20 2015 006 943 | U1 | 2/2017 |
| EP | 3153063 | A1 | 4/2017 |
| EP | 3153064 | A1 | 4/2017 |
| ES | 2467993 | T3 | 6/2014 |

OTHER PUBLICATIONS

European Search Report (EP 18209757.6) dated Feb. 21, 2019, 8 pages.

* cited by examiner

CONNECTION DEVICE AND ITEM OF FURNITURE OR DOMESTIC APPLIANCE

This application claims the benefit under 35 USC § 119(a)-(d) of German Application No. 10 2017 128 746.9 filed Dec. 4, 2017, the entirety of which is incorporated herein by reference.

FIELD OF THE INVENTION

The present invention relates to a connection device and an item of furniture or domestic appliance.

BACKGROUND OF THE INVENTION

Systems or connection devices, respectively, for connecting a sliding element of an item of furniture or of a domestic appliance to a guide rail of a guide system of the item of furniture or domestic appliance are known in different variations.

For example, so-called part-pullouts having two guide rails, or full pullouts having three guide rails, in relation to a pullout functional unit are used as guide systems, wherein the rails are movable in a mutually telescopic manner.

A sliding element such as, for example, a drawer, a shelf base, a food tray, or the like, is typically received in a displaceable manner by way of exactly two separate functional units of the same type of a part-pullout or of a full pullout. The respective functional unit of the pullout guides is preferably fastened to an internal side of a furniture cabinet unit or of a housing of a domestic appliance or kitchen apparatus, respectively.

Since the attachment of a sliding element of an item of furniture or of a domestic appliance to a guide rail has to meet high requirements in terms of functionality, ease of operation and economy, corresponding refinements are necessary.

SUMMARY OF THE INVENTION

It is an object of the present invention to improve items of furniture, or connection devices described in the introduction for connecting a sliding element of an item of furniture or of a domestic appliance such as, for example, a kitchen apparatus, to a guide rail of a guide system the item of furniture or domestic appliance, respectively, in particular, in terms of functionality, ease of operation, and economical production.

The present invention proceeds from a device for connecting a movable sliding element of an item of furniture to a guide rail of a guide system of the item of furniture, or for connecting a movable sliding element of a domestic appliance such as, for example, a kitchen apparatus, to a guide rail of a guide system of the domestic appliance or kitchen apparatus, respectively. This is preferably a positionally correct and secured and/or releasable connection of the sliding element and the guide rail to the device. The device is preferably attachable to the sliding element in a fixed yet releasable manner such as, for example, screw-fittable by way of screw-fitting means. The device is preferably formed as a functional unit that is separate from the sliding element and the guide rail, the functional unit being effective between the sliding element and the guide rail. The device is, in particular, first attached to the sliding element and then, conjointly with the sliding element, as the latter is attached to the guide rail of the guide system which is, in particular, already assembled on the item of furniture or domestic appliance, is brought into releasable contact with the guide rail, or is latched thereon, respectively. The device is moreover adapted such that a connection between the sliding element and the guide rail can be established only when the sliding element and the guide rail are mutually aligned in a positionally correct manner. To this end, portions that are adapted so as to be mutually matching are configured so as to be prepared on the connection device, on the one hand, and on the guide rail or on an intermediate piece that is attached to the guide rail, respectively.

The core concept of the present invention lies in that the device has adjustment means, wherein the adjustment means comprise latching means, an operating element, and a height adjustment element, wherein the latching means have latching teeth and a latching member, wherein the latching teeth are disposed along a shell face, wherein the latching member is connected to the operating element, wherein the latching member latches with the latching teeth, wherein the height adjustment element is configured in the manner of a disk, wherein the height adjustment element is present so as to be pivotable, in particular, rotatable, on the device, wherein the operating element is connected to the height adjustment element, and wherein the device in the disposed state connects the sliding element to the guide rail in such a manner that a positional modification of the height adjustment element causes a positional modification of the sliding element relative to the guide system, in particular, a spatial modification of the sliding element relative to the guide rail. The spatial modification of the sliding element relative to the guide rail, the spatial modification being capable of being performed at any time after the connection of the sliding element to the guide rail, relates, in particular, to a vertical spacing in the assembled state of the sliding element on the guide rail. The preferably annular-disk-shaped height adjustment element across the extent of the portion that is effective with the possible adjustment positions in the various pivoted positions has a thickness that is variable in a stepless manner, for example. The height adjustment element is accordingly preferably wedge-shaped, having a minimum thickness at a free front end of the height adjustment element, and a maximum thickness at the opposite end of the height adjustment element, for example. Depending on the pivoted or rotated position, respectively, of the height adjustment element, another portion of the height adjustment element becomes effective and a respective other thickness of the height adjustment element is thus moved, or pivoted, respectively, in between, for example, a bearing face on the sliding element and an opposite bearing face on the guide rail, so as to be in the region between the bearing faces. The vertical spacing between the bearing faces is modified so as to depend on the pivoted position of the height adjustment element, or so as to depend on the effective thickness of the wedge portion of the height adjustment element, respectively. The bearing face herein is positionally fixed on the guide rail such that the sliding element is vertically adjustable while simultaneously bearing, or being supported, respectively, on the bearing face of the sliding element by way of the height adjustment element. The height adjustment element, or the wedge portion thereof, respectively, is present such that the height adjustment element on one side, or on a lower side, respectively, comes to bear preferably on an upper side of the guide rail, and on an upper side comes to bear on a lower side of the sliding element. The height adjustment element, by way of pivoting, in a horizontal movement forces itself in between the two bearing faces. The pivoting in the use state is preferably performed about a vertical or perpendicular, respectively, spatial axis. The sliding element in the front region of the sliding element rail bears on the upper side of the guide rail so as to be capable of being lifted vertically upward under the effect of the dead or laden weight. Depending on the rotated position of the height adjustment element and thus on the effective portion of the wedge potion element together with the associated wedge thickness of the height adjustment offset, the sliding element in the event of the height adjustment element being pivoted in one pivoting direction is relocated upward relative to the guide or sliding element rail, respectively, or downward in the case of an opposing pivoting direction. The upward adjustment is pushing upward and is performed while overcoming the dead weight of the sliding element. The lowering of the sliding element on account of the effective weight of the sliding element does not require any effort in terms of force. The sliding element herein always remains so as to be supported on the guide rail, wherein the height adjustment element is present therebetween, or so as to be sandwiched between the two bearing faces on the sliding element and the guide rail, respectively. Only in a minimum or maximum passive position of the height adjustment element on the connection device is the latter not present so as to engage between the bearing faces on the sliding element and the guide rail but is at least substantially present or inwardly pivoted, respectively, so as to be within an external shape of the main component.

Since the connection device in the use state is assembled so as to be substantially beside the longitudinal side of the guide rail, preferably in the front end region of the guide rail, the height adjustment element in the maximum inwardly pivoted minimum position is present on the device and therefore not effective in a spatially modifying manner. The height adjustment element does not engage in the horizontal gap region between the lower side of the sliding element and the upper side of the guide rail. The sliding element base herein bears directly on the upper side of the guide rail. The neighboring bearing faces, in particular, the sliding element lower side and the sliding element guide rail upper side, in the use state are preferably aligned so as to be horizontal and mutually parallel.

The wedge thickness varies across the extent of the height adjustment element, preferably between, for example, 0.1 millimeters at the free end of the wedge portion and, for example, approximately 3 to 5 millimeters at the other end of the wedge portion, the latter in a maximum pivoted position of the height adjustment element being forced between the bearing faces. The sliding element lower side and thus the sliding element can thus be lifted by, for example, approximately 3 to 5 millimeters in the vertical height on the item of furniture, or relative to the guide rail that is positionally fixed in the height direction, respectively, wherein any lifting on account of the height adjustment element being pivoted is reversible to the other direction, thus capable of being reset, and the sliding element thus be lowered again, or arbitrary intermediate positions are possible, respectively. Other desired maximum adjustment values can be implemented, depending on the configuration of the gradient of the wedge portion. In principle, a configuration of the gradient of the wedge portion that is not steady, or not linear, respectively, for example, a curved or stepped, configuration, is also not precluded.

A height adjustment that is easy to operate and capable of being finely set is enabled by the adjustment means according to the present invention. The height adjustment element across the entire potential adjustment path thereof or, for example, across the entire potential rotation angle of the rotating movement of the height adjustment element, respectively, slides in the manner of a wedge between the respective bearing faces and thus, depending on the maximum thickness of the portion of the wedge, or of the height adjustment element, respectively, that is present therebetween, predefines the spacing between the bearing faces and thus the height position of the sliding element in relation to the guide rail, or on the item of furniture, respectively. The spacing between the bearing faces can be modified in a stepless manner since the height adjustment element in relation to a planar first wedge side that is horizontal in the use state preferably comprises a second opposite wedge side that runs obliquely to the first wedge side. By contrast, the height adjustment of the sliding element is typically performed by way of minor steps which are negligible in practice, so as to depend on the spacings of neighboring latching teeth and thus on the latching spacing of the latching action that is capable of being established by way of the latching member and the respective next or preceding latching tooth, respectively, of the latching teeth. For example, the latching tooth spacings and the gradient of the wedge portion of the height adjustment element are mutually adapted in such a manner that the vertical or height adjustment, respectively, of the sliding element can be performed in comparatively small steps of preferably approximately 0.5 to 1.0 millimeters.

The first horizontal wedge side of the height adjustment element in the assembled state preferably bears on the bearing face of the sliding element, or the lower side of the latter, respectively, across the entire pivoted angle that is swept in the pivoting of the height adjustment element. The oblique second wedge face that is vertically opposite the first wedge face spaced apart by way of the wedge thickness in the inwardly pivoted state is free in relation to portions of the device, and thus is rotatable past the portions without any contact, or friction, respectively. The oblique wedge face in the outwardly pivoted state preferably comes to bear on the bearing face, or on the upper side of the guide rail, respectively.

The maximum rotation angle that is capable of being swept by the height adjustment element which can be reciprocally pivoted in an arbitrary reversible manner, the maximum rotary angle being determined between detents for the height adjustment element and/or of the latching member on the connection device, is preferably approximately 80 to 100 degrees, preferably approximately 90 degrees.

The latching means are, in particular, provided in order for any unintended or self-acting adjustment, respectively, of the height adjustment element and thus of the height position of the sliding element on the item of furniture or domestic appliance on account of unavoidable static but, in particular, dynamic effects such as, for example, vibrations of the sliding element, or of the guide system, respectively, not to be suppressed in the utilization of the sliding elements.

The adjustment means for the height adjustment of the sliding element on the item of furniture, or on the domestic appliance, respectively, or the operating element such as, for example, an operating lever having a contact pressure surface, in the completely assembled state of the sliding element on the item of furniture or the domestic appliance, respectively, are preferably readily accessible to and operable by a person, even if advantageously not visible but obscured by the sliding element in the use state when viewed from the front, or from an operating side, respectively. The connection device is therefore preferably positioned so as to be adjacent to a rear side of a front element of the sliding element, or thus in the front end region of the guide system, or of the sliding element guide rail, respectively, for example, screw-fitted to the sliding element base and/or the front element. The sliding element guide rail by way of the front end thereof typically reaches up to or close to the front element such that the operating element is readily accessible from the front of the item of furniture by hand by way of the latter engaging below a lower edge of the front element. The operating element in haptic terms is preferably advantageously designed so as to be easily operated, for example, having an external rough or fluted feature.

For the height adjustment it has only to be guaranteed that the lower side of the sliding element in the front end region thereof is accessible from below for manually operating the adjustment means or the operating element, respectively. For example, to this end the sliding element is pulled out somewhat toward the front from the fully retracted position on the item of furniture, or from the closed position, respectively. The sliding element rail in this instance is displaced somewhat or relative to a cabinet unit rail or central rail, respectively, or is extended in length as compared to the nested guide system.

The person can then handle the connection device by way of the sliding element that in relation to a front plane of the item of furniture projects forward, the, handling being performed on the lower side on the sliding element. The operating element can thus be manually operated, this being possible by way of a simple manipulation. The operating element herein is preferably adjustable without any noticeable effort in terms of force and by a comparatively short adjustment path, for example, in the range of millimeters, or in steps of millimeters, respectively, up to, for example, approximately 30 millimeters in relation a circumferential line of the operating element relative to the pivot axis of the height adjustment element, the pivot axis preferably coinciding with the pivot or adjustment axis, respectively, of the operating element.

The guide rail is, for example, or preferably, respectively, a sliding element rail, in particular, a drawer rail of a part-pullout or full pullout having telescopic guide rails.

The present invention in more specific terms relates, in particular, to a furniture drawer connection device, or a domestic appliance drawer connection device.

For example, a front panel on an item of furniture or domestic appliance, respectively, can, in particular, be finely set in terms of horizontal positions on the item of furniture by way of the connection device, on account of which a uniform visual appearance of the panel gaps on the item of furniture or domestic appliance is possible, in particular. In the case of two or more drawer elements on an item of furniture, the vertically neighboring horizontal peripheries of a sliding element front side thereof are indeed often present so as to differ by a few millimeters in the vertical direction in relation to neighboring horizontal peripheries on the item of furniture. This is undesirable for visual or aesthetic reasons, respectively. A non-horizontal peripheral profile can also be alleviated in that the adjustment means of the connection device on the left functional unit of the guide system on the sliding element and the adjustment means on the right functional unit of the guide system on the sliding element are utilized such that the sliding element is horizontally aligned. By way of the height adjustment of the sliding element in the case of two guide system functional units, or guide systems on both lateral or lower sides on the sliding element, respectively, that are typically present, the front panel on the item of furniture above and/or below a sliding element is uniformly adjustable to a uniform front panel gap having a uniform vertical gap width relative to the respective horizontal periphery of the neighboring sliding element or of other furniture horizontal peripheries with a precise alignment that is parallel with the horizontal.

The connection device preferably has latching coupling means by way of which the connection device, in particular, in the attached state on the sliding element, is capable of being coupled in a latching manner to a mating contour which is present on the guide rail of the guide system or an intermediate piece, such that a latching coupling for the secured but releasable and positionally correct connection of the sliding element on the guide system is provided. The connection device according to the present invention is therefore particularly preferably designed as a height adjustment latching coupling.

It is furthermore advantageous for the height adjustment element, the operating element, and the latching member to be configured so as to be integral. The connection device according to the present invention is economically advantageously producible by way of such an actuator component 54. The actuator component 54 which is releasably plug-fittable to a main component of the device, for example, in a region about the pivot axis, for example, has a central portion which is connected to the height adjustment element and the operating element. The central region can comprise an annular region for encompassing a pivot axis element on the main component. A member which is capable of elastically yielding and which is, for example, L-shaped, or a spring member, or an elastic member for receiving the operating element, respectively, is preferably present on the central portion, which will be described hereunder.

A separate actuator component 54 which comprises the height adjustment element, the operating element, and the latching member is preferably formed. The actuator component 54 and the main component are preferably composed of a plastics material, or are in each case an injection-molded part, respectively. The connection device preferably comprises exactly two in each case integral components, the main component and the actuator component 54, the two latter being capable of being plug-fitted to one another for completion. The main component and the actuator part advantageously have in each case a different color, the main component being light gray and the actuator part being green, for example. Further functional features such as, for example, fastening means for the positionally correct attachment of the connection device to the sliding element and the guide rail are preferably present on the main component.

It is moreover advantageous for the latching teeth to be disposed along a conical face. The conical face in geometric terms is understood to be the conical surface. This is advantageous for a compact design and a mechanically reliable latching action. The latching teeth on the conical face are advantageously configured so as to be integral to the latter. The respective tip, or each latching elevation of a latching tooth, respectively, preferably runs along an associated shell line of the respective cone. The conical face is formed by an external side of a cone or of a truncated cone, for example. The latching teeth are, in particular, designed along a conical shell face. The conical face is preferably a partial circumferential face of a conical shell face.

The latching teeth are preferably designed in the manner of webs or ribs, respectively, the webs or ribs thereof, respectively, being in each case configured on the conical face so as to be linear and mutually identical.

The latching teeth have latching elevations and latching depressions which are designed beside one another in an alternating manner on the conical face and so as to be circumferential in relation to the rotation axis of the height adjustment element. For example, 15 to 20 latching elevations and in each case one depression between each two neighboring elevations are provided in relation to the rotation axis of the height adjustment element across an angular range of approximately 90 degrees. With the exception of preferably at least one retaining tooth of the latching teeth, such as, for example, a first and/or last latching tooth in the row of the latching teeth, all of the latching teeth are preferably designed so as to be mutually the same or identical. This is advantageous to, for example, a form-fitting connection between the one latching member and each of the latching teeth.

The latching member that is capable of latching with the latching teeth, or engages in the latching teeth, respectively, preferably has a latching elevation and on both sides thereof latching member flanks that delimit the latching elevation. The latching elevation and the latching member flanks are designed in such a manner that the latching member, in a latched state of the latching member with a portion of the latching teeth, engages in a matching manner and bears in a planar manner on the faces of the latching elevation and of the latching depression of the tooth contour of the associated or respective latching tooth, respectively.

The latching member preferably has the matching mating shape of a latching depression of the latching teeth, the latching depression being configured between two latching elevations.

Accordingly, it is advantageous for the latching member flanks of the latching member in the latched state to engage in a matching manner and by way of a planar contact in a latching depression of the latching tooth.

The latching teeth are advantageously disposed beside one another in a row. The latching teeth are disposed along the contour of the shell face, the contour in the cross section of the shell face being circular. The shell face preferably has an extent or depth, respectively, that is axial in relation to the rotation axis of the height adjustment element, the latching teeth by way of the length thereof that is axial to the pivot axis preferably being configured so as to be continuous along the axial extent or depth, respectively.

It is also advantageous for the latching teeth to have latching faces, wherein the latching faces enclose a latching angle, wherein the latching angles of the latching teeth are identical. The latching angles of preferably all latching teeth are mutually identical. On account thereof, in particular, a toothing profile or a helical toothing profile, respectively, for example, in the manner of a sawtooth profile, is provided. A latching tooth accordingly has tooth flanks which converge and meet in a latching tooth tip. The latching tooth tip forms the end of the latching elevation. The latching faces form portions or flanks, respectively, of the latching elevations or of the latching depressions, respectively.

By way of the identical latching angles of all latching teeth, for example, it is advantageously possible for a latching action having a maximum latching effect to always be achieved between the latching member and the in each case respective portion in the row of the latching teeth, independently of the chosen latching position of the latching member. The latching angle is, for example, between 40 and 60, preferably 50 degrees.

An advantageous modification of the present invention is provided in that the latching teeth comprise a retaining tooth, wherein the shape of the retaining tooth differs in each case from the shape of the remaining latching teeth. The remaining latching teeth are preferably mutually identical.

The retaining tooth is advantageously provided for the comparatively stronger latching action of the latching member, for example, in a transportation position of the device, such as for a shipping state of the device to a customer, for example. In particular, the height adjustment in the transportation position is not in an effective position, or in the minimum position, respectively, in which the height adjustment element is located in a maximum inwardly pivoted position on the connection device.

The retaining tooth is designed such that the operating and adjusting force that is required for cancelling the latching action of the latching member on the retaining tooth is higher than for cancelling a latched position of the latching member with one of the remaining latching teeth. The latching action of the latching member in the transportation position can thus be cancelled only by way of a comparatively higher effort in terms of force, or if a higher latching resistance is established, respectively.

A latching face having two different latching face portions is preferably provided by way of the retaining tooth. The two latching face portions form the opposite flanks of the retaining tooth, wherein the two flanks converge in a tip of the retaining tooth.

One of the two latching faces on the retaining tooth preferably has two dissimilarly aligned straight latching face portions. The surface normal of the one latching face portion is dissimilar to the surface normal of the other latching face portion, or the two latching face portions have in each case a different gradient, respectively.

One latching face portion in relation to the further latching face of the retaining tooth advantageously encloses an angle which is identical to the latching angle of the remaining latching teeth.

In particular, the retaining tooth in the radial direction relative to the rotation axis of the height adjustment element is slightly longer, for example, by approximately one millimeter, or the fraction of a millimeter, than is the case with the remaining latching teeth. Accordingly, the tip of the retaining teeth in radial terms is thus spaced farther apart from the pivot axis than the respective tip of the remaining latching teeth.

Another advantageous design embodiment of the present invention results from the fact that the latching teeth are disposed beside one another in a row, wherein the retaining tooth in the row is disposed on an external side. The retaining tooth is thus a first and/or last tooth in the row of all latching teeth. The retaining tooth is accordingly preferably provided at a beginning of the latching region having the latching teeth, in particular, at a first and/or last position of the latching teeth where a first or last, respectively, latching position, or latching action, respectively, with the latching member is possible. This corresponds, for example, to the position of the height adjustment element in which the height adjustment element is not effective. The height adjustment element in this position, relating to the assembled use state, does not engage between the bearing face on the sliding element and the bearing face on the guide rail. The height adjustment element is inwardly pivoted and is thus rendered passive in terms of the lifting effect thereof for increasing the height position of the sliding element.

It is furthermore advantageous for a first latching face of the latching teeth when viewed in a first adjustment direction of the latching member to have a larger gradient than a gradient of the second latching face of the latching teeth when viewed in a second adjustment direction of the latching member. It is thus possible for an, in particular, manual adjustment of the latching member and thus of the height adjustment element in the second adjustment direction to be implemented in a comparatively simpler or easier manner than is the case with the adjustment in the first direction. The latching faces of a latching tooth on the respective side of the latching tooth form, in particular, a detent for the latched latching member. In order for a latching member in the latched state between two latching elevations of neighboring latching teeth to be moved out of the latching action and in the first adjustment direction, a force has to be applied that is higher as compared to the force to be applied which is required for moving the latching member from the latching action and for moving the latching member in the second adjustment direction. A higher resistance to moving or adjusting, respectively, the latching member from a latched position in the first adjustment direction is implemented by way of the larger gradient of the respective latching faces of the latching teeth, as compared to the resistance to adjusting the latching member in the second adjustment direction from a latched position.

For example, an adjustment of the latching member in a first direction can be impeded in terms of a self-acting or unintentional adjustment, respectively, the direction being facilitated by virtue of the acting weight of the sliding element in the use state, for example. A larger gradient of the respective latching face and thus a higher resistance to adjustment in this direction counteracts a self-acting adjustment of the latching member.

It is also advantageous for a latching face of a latching tooth to form, in particular, a detent for the latching member. A latching action of the latching member on the latching teeth is thus enabled in a simple manner. The latching member and the latching face of each latching tooth are preferably adapted such that a self-locking planar bearing of portions of the latching member and of the latching face is enabled in the latched state.

In principle, the height adjustment element is configured in such a manner that the height adjustment element in the direction of extent has an increasing or decreasing thickness, preferably a thickness increasing or decreasing in a stepless manner. The variable thickness relates to at least that part of the height adjustment element that by pivoting or rotating the height adjustment element is capable of being moved in part or across the entire extent between the bearing face of the sliding element and the bearing face of the guide rail.

In principle, a linear movement of the height adjustment element, or a superimposed linear and non-linear manner of movement of the height adjustment element is likewise conceivable as an alternative to the pivoting or rotating of the height adjustment element.

An advantageous modification of the present invention is distinguished in that the height adjustment element is present in the form of a circular disk, in particular, in the form of a divided circular disk, wherein a thickness of the circular disk is configured so as to increase or decrease along a circular path about the pivot axis of the height adjustment element. The height adjustment element is preferably configured in the form of a wedge-shaped divided annular disk, or divided circular disk. The divided annular disk is formed across an angular range of preferably approximately 90 degrees that is circumferentially spaced apart from the pivot axis of the height adjustment element, and across an inner radius that is spaced apart from the rotation axis in the axial direction to an outer radius, thus in the shape of, for example, a quarter annulus, or of a divided annulus. The thickness of the height adjustment element at the front free end of the height adjustment element is minimal, and the thickness of the height adjustment element at the other end in the circumferential direction in relation to the pivot or rotation axis, respectively, of the height adjustment element is maximal.

It is also advantageous for the operating element to have an elastic member, wherein the operating element is connected to the height adjustment element by way of the elastic member.

The latching member is preferably present on the operating element. The latching member is thus mounted in a sprung manner on the device.

The latching member is preferably pretensioned in an elastic manner in the latching direction, or by way of a spring force is urged in the direction toward bearing on the respective portion of the latching teeth, respectively, preferably under the effect of the elastic member. The latching member can be received on a remaining portion of the adjustment means by way of the elastic member, or by way of spring means for providing a spring force, such as a sprung arm, respectively, for example. A sprung mounting of the latching member is preferably established by way of the spring means, the sprung mounting being designed in such a manner that the latching member in the direction counter to the effective direction of the spring force can be moved by pressure from the outside on the operating element from a pretensioned latched position on the latching teeth that is implemented by means of the spring force. Subsequently the pivoting or rotating position, respectively, of the latching member is possible. When the height adjustment has been completed and the compressive force no longer acts from the outside on the operating element, the latched position in the newly established latched position of the latching member by virtue of the pre-tension or spring force, respectively, that permanently acts on the latching member is established directly and in a self-acting manner, or is secured against being adjusted, respectively.

The assembly is adapted such that the latching member, without any force acting on the operating element from the outside, positively reaches the exact chosen adjusted or latched position, respectively, on the latching teeth. After the removal of the operating or adjusting force, respectively, acting on the operating element from the outside, only a comparatively very short distance of, for example, 0.5 to 1.5 millimeters is travelled by the latching member. This distance corresponds to the distance which has previously been overcome manually by the operator. The latching member herein from the non-latched position, according to the newly chosen rotated position of the height adjustment element moves in a sprung manner back to the new position of the latching member between the latching teeth, such that the latching member is again latched in this instance.

It is moreover also advantageous if the operating element in relation to a surface of the height adjustment element is present so as to be offset in the direction of the rotation axis of the height adjustment element, wherein the operating element is movable relative to the rotation axis of the height adjustment element. The operating element has two directions of movement, or degrees of freedom, respectively, the first so as to be capable of yielding in a resettable manner from the radial position relative to the pivot axis by way of the elastic member, and the second so as to be pivotable for the actual height adjustment in a reciprocating manner about the pivot axis, or circumferentially, respectively, by way of the pivot mounting of the actuator part 54. The operating element is preferably present so as be parallel with the rotation axis of the height adjustment element and so as to project from a surface of the height adjustment element, wherein the operating element is present so as to be movable in a direction toward the surface and/or away from the rotation axis. An adjustment of the latching member by way of short adjustment distances is thus enabled in a space-saving manner.

The present invention finally relates to an item of furniture or to a domestic appliance such as, for example, a kitchen apparatus, having a device according to one of the above embodiments.

The abovementioned advantages can thus be implemented on an item of furniture or a domestic appliance. The sliding element in the case of the item of furniture is a drawer, for example. The sliding element in the case of a domestic appliance such as, for example, a kitchen apparatus such as an oven, is a food tray or a rack.

BRIEF DESCRIPTION OF THE DRAWINGS

Further features and advantages of the present invention are explained in more detail by means of the exemplary embodiments of the invention which are schematically illustrated in the figures in which.

DETAILED DESCRIPTION OF THE INVENTION

The same reference signs are used to some extent hereunder for elements of dissimilar embodiments that are inherently equivalent.

Figure 1:
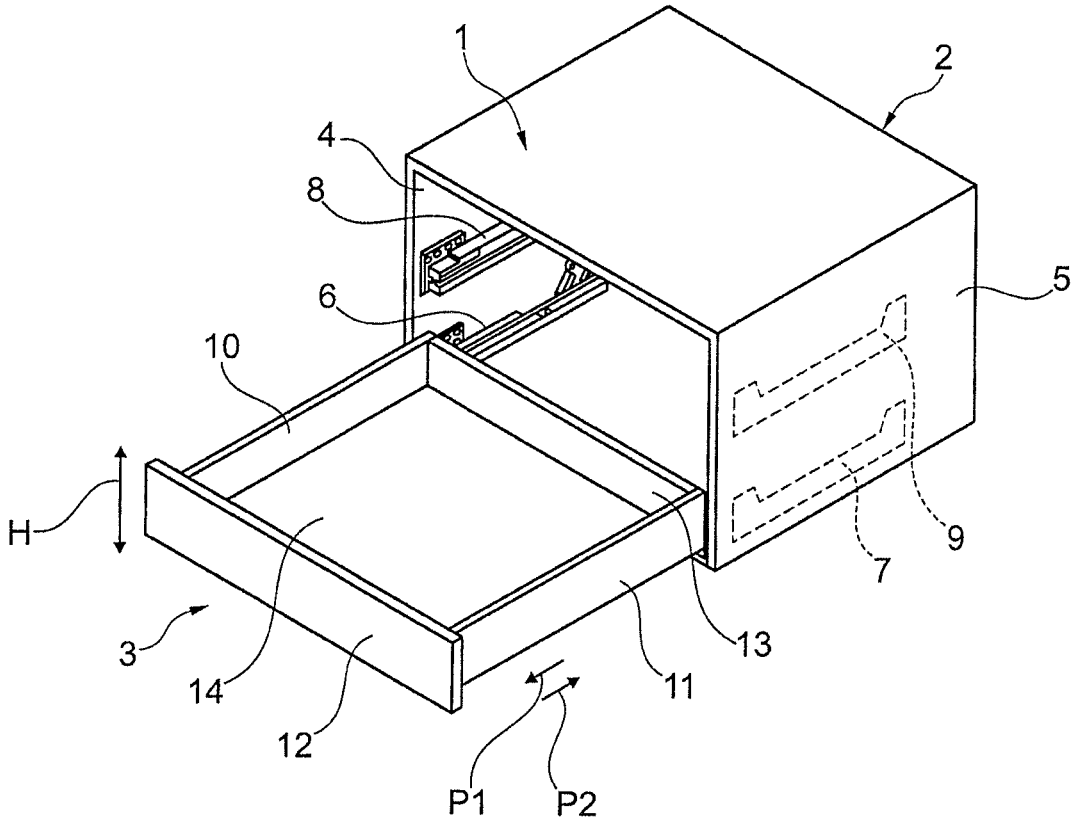
FIG. 1 shows a schematically illustrated item of furniture according to the present invention in a perspective view obliquely from above, having a drawer received thereon in a displaceable manner.

FIG. 1 in a highly schematic manner shows an item of furniture 1 according to the invention, in a use state and having a hollow cuboid furniture cabinet unit 2 and a sliding element that is configured as a drawer 3, wherein the drawer 3 is received so as to be displaceable on the furniture cabinet unit 2. The furniture cabinet unit 2 comprises two opposite vertical side walls 4 and 5, the drawer 3 therebetween by means of a guide system according to the invention, having telescopic guide means, or a first rail full pullout 6 and a second rail full pullout 7, being capable of being pulled out of a state located in the interior of the furniture cabinet unit 2 in a horizontal direction, according to 91, and being able to be pushed into the furniture cabinet unit 2 in the opposite direction, according to P2. The drawer 3 in FIG. 1 is shown in the maximum state of being moved out of the interior of the furniture cabinet unit 2, or in the completely moved out state, respectively. The storage volume of the drawer 3 can thus be accessed in an almost impeded manner from above.

When the drawer 3 instead of the rail full pullouts 6, 7 uses in each case one rail part-pullout, the drawer 3 in the maximum moved-out state cannot be moved that far out from the interior of the furniture cabinet unit 2 in the direction P1 as is possible with the rail full pullouts 6, 7 according to the illustration in FIG. 1. The front element 12 in this instance is closer to the open front side of the furniture cabinet unit 2 than is shown in the case of the drawer 3 according to FIG. 1.

The rail full pullout 6 that is screw-fitted to the inside of the side wall 4 is located at the same vertical level so as to be opposite the rail full pullout 7 which is screw-fitted to the side wall 5 and is obscured in FIG. 1, the rail pullout 7 being indicated by dashed lines.

A further drawer which is not illustrated in FIG. 1 and which is guided in a corresponding manner by way of rail full pullouts 8 and 9 can be accommodated in the furniture cabinet unit 2 above the drawer 3.

The drawer 3 has opposite drawer side walls 10, 11 which in each case comprise a constructed cavity frame. Moreover, the drawer 3 comprises a front element 12, a rear wall 13 that in the horizontal direction is opposite the front element 12, and a horizontally extending drawer base 14 which reaches up to the drawer side walls 10, 11, the front element 12, and the rear wall 13, or is connected to the drawer side walls 10, 11, the front element 12, and the rear wall 13, respectively.

Figure 2:
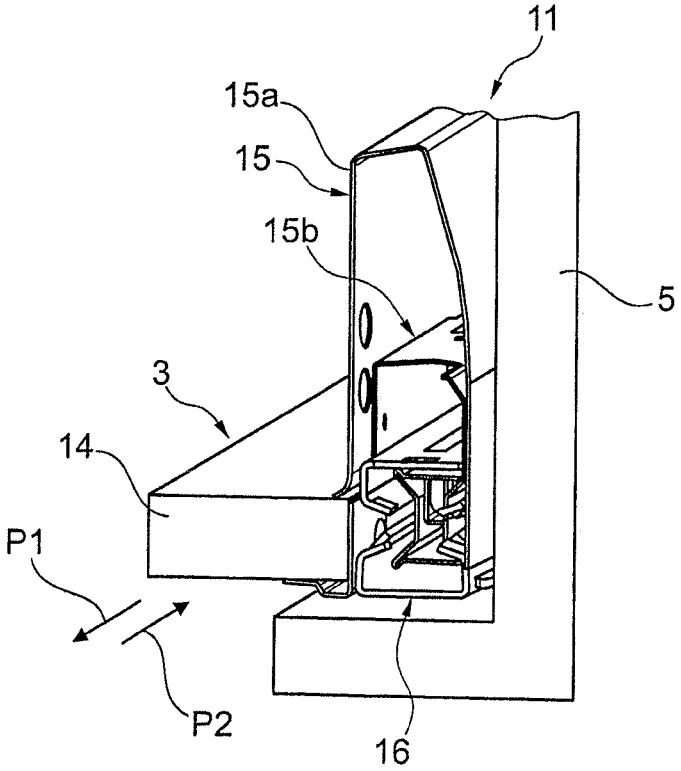
FIG. 2 shows in the cross section a perspective fragment of an item of furniture according to the present invention in the region of a drawer side, neighboring a furniture cabinet unit wall and a furniture cabinet unit base.
Figure 3:
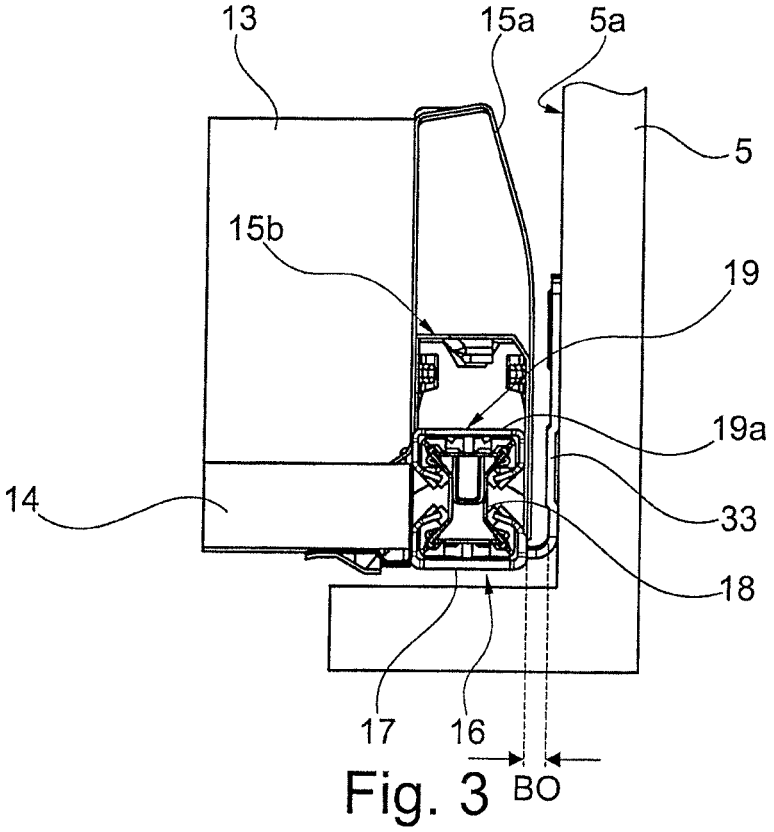
FIG. 3 shows the fragment according to FIG. 2 in an end view.

FIGS. 2 and 3 in the region of a cabinet unit side wall 5 show a fragment of a drawer 3 having a drawer base 14 and a drawer side wall 11, configured as a cavity frame 15, and a rear wall 13. The drawer 3 by way of two functional units of a guide system according to the invention is received on the furniture cabinet unit 2, or by way of a rail full pullout 16 according to the invention is received on the side wall 5 and in an identical manner by way of a further cavity frame of the drawer 3 is received on the side wall 4 (not visible in FIG. 2). Receiving on the side wall 4 is performed by way of a further functional unit, or of a further full pullout according to the invention, respectively, the drawer 3 by way of the further full pullout being displaceable in a linear horizontal manner in the directions P1 and P2.

The cavity frame 15, preferably from a bent sheet metal material, has an outer housing 15*a* and an internal structure 15*b* such that the full pullout 16 is capable of being accommodated in a recessed manner in the internal volume of the cavity frame 15. The cavity frame 15 on an internal side of the lower portion thereof is configured for receiving a longitudinal periphery of the drawer base 14.

The full pullout 16 according to the present invention, formed as a functional unit of the guide system, comprises three mutually telescopic guide rails, or one cabinet unit rail 17, one central rail 18, and one sliding element rail 19, respectively.

The central rail 18 is configured as a hollow section according to the present invention.

Figure 4:
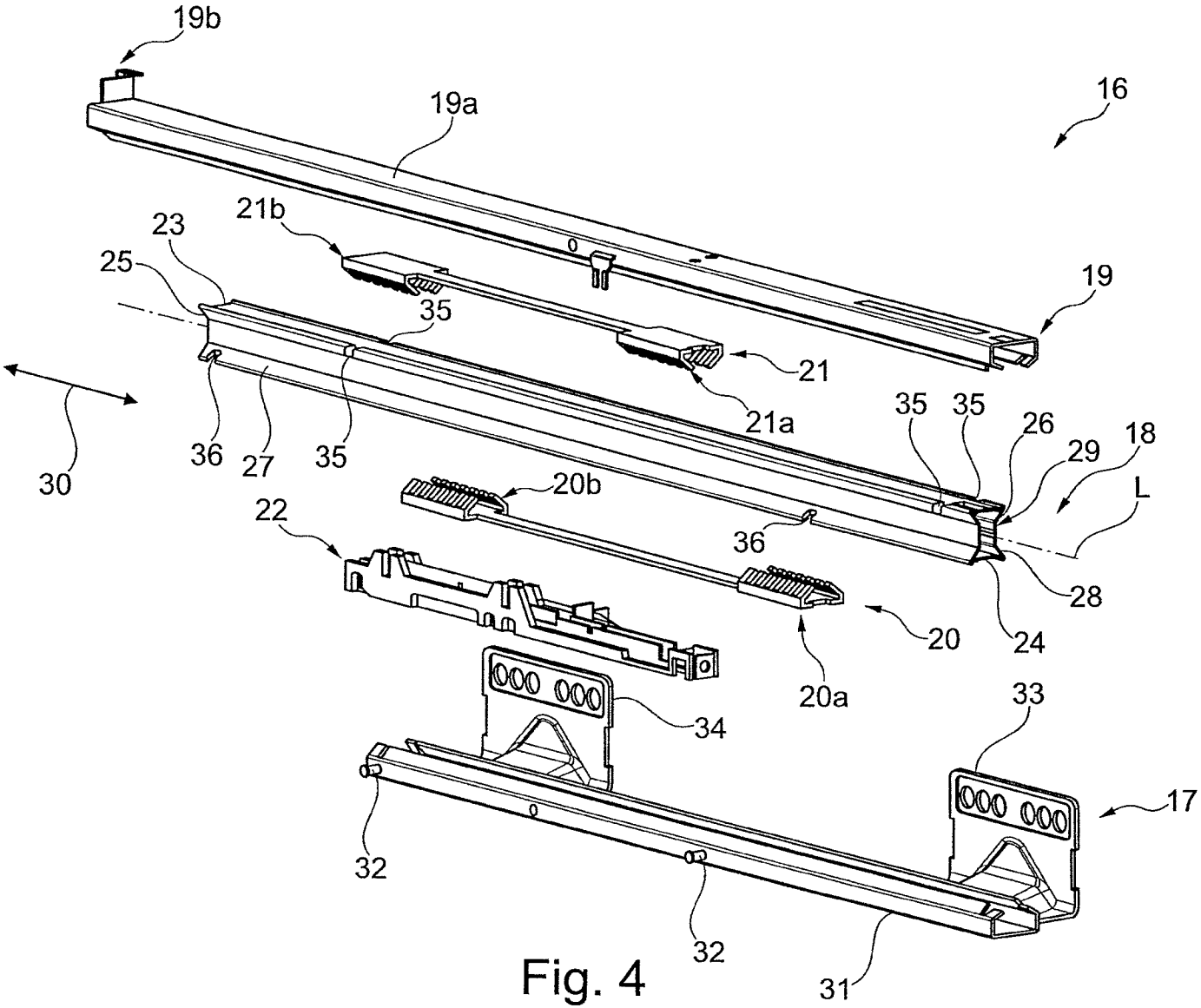
FIG. 4 shows an exploded illustration of a functional unit of a guide system according to the invention.

A sliding element to be moved, such as the draw 3, is coupled or connected, respectively, to the sliding element rail 19, for example, is fixed to the cavity frame 15, whereas the cabinet unit rail is connected to the stationary part of the item of furniture. When the full pullout 16 is used as an underfloor guide, a lower side of a sliding element, or the base thereof, respectively, is supported on an upper site 19*a* of the sliding element rail 19. A hook element 19*b* which at the rear end of the sliding element rail 19 projects upward forms a detent for a portion of a rearward external side of the sliding element, wherein for the exact positioning a portion of the hook element 19*b* that is angled so as to be parallel with the upper side 19*a* engages in a depression prepared in a matching manner in the rearward external side of the sliding element. That region of the full pullout 16 which in FIG. 4 is the rear region in relation to the use state is thus also established on the left side in FIG. 4, or a region that in the use state is the front region of the full pullout 16 is established on the right side in FIG. 4, respectively. A forward or rearward, respectively, sliding direction 30 of the rails 18 and 19 that in the use state of the full pullout 16 is horizontal and linear is indicated by a double arrow in FIG. 4.

The full pullout 16 moreover comprises a first, or lower carriage 20, respectively, having bearing members disposed thereon, wherein the carriage 20 between the cabinet unit rail 17 and the central rail 18 acts for a load-transmitting relative movement of the rails 17, 18.

The full pullout 16 furthermore comprises a second, or upper carriage 21, respectively, having bearing members disposed thereon, wherein the carriage 21 between the central rail 18 and the sliding element rail 19 acts for a load-transmitting relative movement of the rails 18, 19.

Pins 32 by way of which a motion mechanism 22 of the full pullout 16, for example, for ejecting and/or retracting the draw 3, is attachable are present on a vertically standing, inwardly pointing narrow side of a rail member 31 of the cabinet unit rail 17.

Two L-shaped fastening elements 33 and 34 are part of the cabinet unit rail 17, wherein the fastening elements 33 and 34 serve for fastening or fixing, respectively, the full pullout 16 to an internal side of the side wall of the cabinet unit, such as the internal side 5*a* of the side wall 5 of the furniture cabinet unit 2 of the item of furniture 1.

The fastening elements 33 and 34 in the exemplary embodiment according to FIG. 3 have a horizontal leg which is severely shortened in the width and which has the width B0. A spacing of the external side of the cavity frame 15 from an internal side 5*a* of the side wall 5 can be minimised therewith, this maximising a receptacle volume of the drawer 3.

The guide rails 17, 18, 19 are preferably composed of a sheet metal material which, proceeding from the flat sheet metal material, is formed to the final product of the respective guide rail, for example, by a punching and bending method.

Upper detents 35 and lower detents 36 are present on the central rail 18 for restricting a relative movement of the lower carriage 20 and of the upper carriage 21 in relation to the central rail 18 in the longitudinal extent of the central rail 18 according to a central longitudinal axis S (cf. FIG. 4).

In the case of the assembled full pullout 16, the bearing members received on the carriages 20, 21 run on the outwardly directed sides of the central rail 18, or the horizontal wall portions 23, 24 and the side wall portions 25 to 28, respectively. The lower carriage 20, by way of the portions 20*a* and 20*b* thereof that support the bearing members, externally encompasses the horizontal wall portion 24 and the side wall portions 27, 28.

The upper carriage 21, by way of the portions 21*a* and 21*b* thereof that support the bearing members, externally encompasses the horizontal wall portion 23 and the side wall portions 25, 26.

Accordingly, the respective associated bearing members of the lower carriage 20 roll on the distal side of the lower horizontal wall portion 24, on the external side of the side wall portion 27, and on the external side of the side wall portion 28.

The respective associated bearing members of the upper carriage 21 roll on the distal side, or the external side of the upper horizontal wall portion 23, respectively, on the external side of the side wall portion 25, and on the external side of the side wall portion 26.

The bearing members of the carriages 20, 21 are preferably external cylindrical bearing members or rolling bearing members, respectively, such as bearing rollers or bearing needles.

The central rail 18 which is formed from an originally flat planar sheet metal is formed as a hollow section and across the length according to the longitudinal axis S has a materially integral connection, or a welded connection, or a narrow weld seam 29, respectively. The weld seam 29 that is preferably established by way of a continuous laser method on one side of the central rail 18 connects narrow, mutually abutting peripheries of a lower part-region and an upper part-region of the central rail 18.

The hollow section shape of the central rail 18 in mechanical terms enables a highly stable, in particular, flexurally rigid and torsionally rigid, central rail 18.

The central rail 18, according to the shaping thereof, is moreover configured so as to be compact, or space-saving, respectively, and material-saving.

Figure 5:
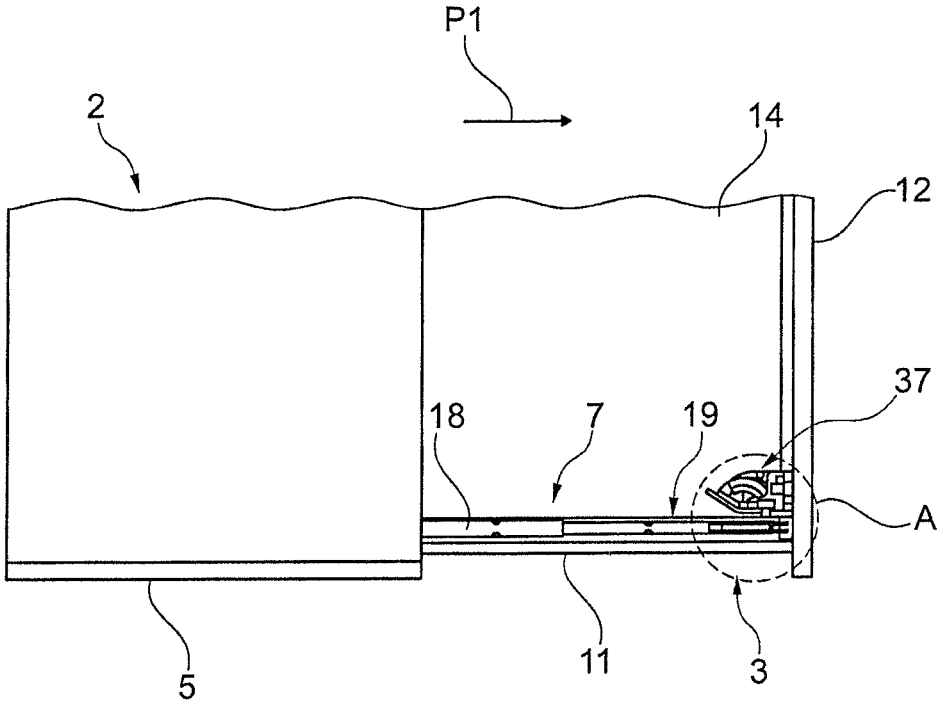
FIG. 5 shows a fragment of a lower view of the item of furniture according to FIG. 1.

FIG. 5 shows the item of furniture 1 according to FIG. 1, without a left part-region, when seen from the front, from below, or in a lower view, having the drawer 3 deployed in the direction P1. An exemplary connection device 37 according to the present invention acts on the rail full pullout 7, which is designed as a full pullout 16 according to FIG. 4. The connection device 37 serves inter alia for the vertical or height adjustment, respectively, of the drawer 3 relative to the furniture cabinet unit 2.

Figure 6:
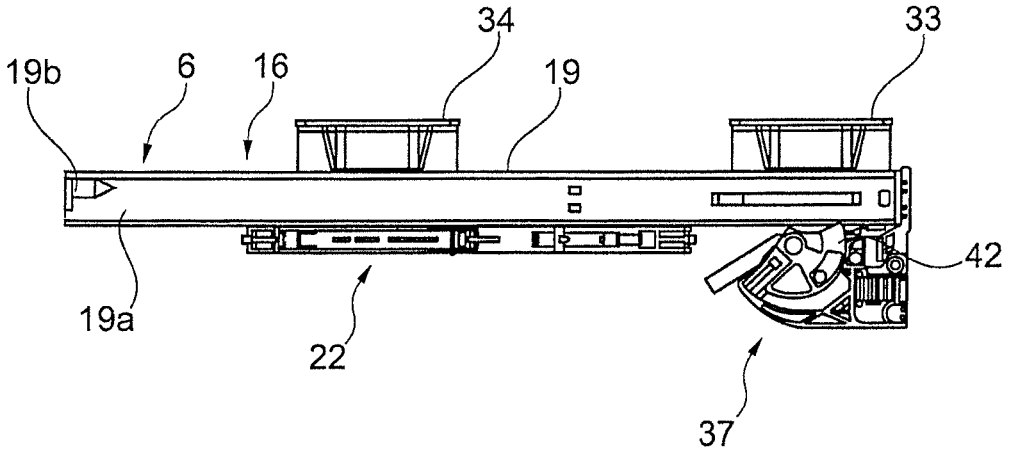
FIG. 6 shows a further full pullout (not illustrated in FIG. 5) having a connection device according to the invention from above.

A corresponding connection device 37 according to the present invention acts on the rail full pullout 6 (not shown in FIG. 5) that is required for moving the drawer 3, the rail full pullout 6 being likewise designed so as to correspond to the full pullout 16 from FIG. 4. The connection device 37 is preferably composed from a plastics material or a light metal material. FIG. 6 shows only the fully contracted rail full pullout 6 from above, having the connection device 37 which is disposed in a functionally correct manner on the rail full pullout 6 and which is located in a minimum position, the latter being explained hereunder. The drawer 3, by way of an in each case lateral part of the lower side of the drawer base 14, is accordingly supported on the two rail full pullouts 6 and 7, or on the respective upper side 19*a* of the sliding element rail 19, respectively.

The drawer 3 in the height position relative to the furniture cabinet unit 2 is thus adjustable on both sides. To this end, a person manually activates from below the two connection devices 37 that are present below the drawer 3, for example, when the drawer 3 is completely deployed according to FIGS. 1 and 5.

The connection device 37 is screw-fitted below the drawer 3, or to a lower side of the drawer base 14 in the region of a front base corner region, respectively, for example, by way of screw-fitting means such as two screws 38 which engage through prepared openings in the connection device 37 and are screw-fitted to the lower side in the drawer base 14. A fastening of the connection device 37 to the rear side on the front element 12 is likewise possible.

The connection device 37 comprises adjustment means 39, wherein the adjustment means 39 have latching means 40, an operating element 41, and a height adjustment element 42. The latching means 40 have a plurality of latching teeth 43 that are disposed in a row, and a latching member 44.

The latching member 44, depending on the setting of the connection device 37, interacts with a portion of the row of latching teeth 43. The latching teeth 43 are disposed along a shell face 45 on a main component 46 of the connection device 37. The latching member 44 is connected to the operating element 41 and by way of the latching teeth 43 projects from the operating element 41 in the direction of the shell face 45. The latching member 44 in the case of the embodiment illustrated is configured so as to be integral to the operating element 41, or so as to be integral on the latter, respectively. The operating element 41 in the region of a curved clearance 55 the main component 46 is disposed so as to be adjustable in a reciprocating manner.

Figure 7:
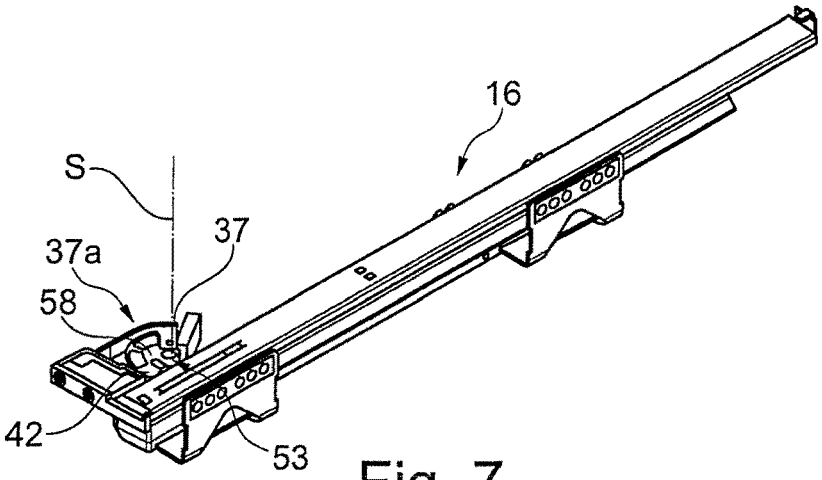
FIG. 7 shows a perspective view of the assembly according to FIG. 6.

The main component 46 is preferably a narrow plastics material part which is provided with webs and cavities and is plate-shaped in the main design, for example, and which preferably comprises hollow portions, for example, or chamber portions that are separated from the peripheral and internal webs. The planar narrow ends on the upper side of the webs of the main component 46 define a plane of an upper side 37*a* of the connection device 37 (cf. FIG. 7), the connection device 37 bearing on the planar drawer base lower side by way of the upper side 37*a*. A rotary mounting 53 of an actuator component 54, or of the height adjustment element 42, respectively, is also designed on the upper side 37*a*.

The height adjustment element 42 has an upper side having upper-side planar end portions, the upper-side end portions being aligned with the upper-side ends of the webs of the main component 46, or lying in the plane of the upper side 37*a*, respectively.

This means that the upper-side ends of the webs of the main component 46 and of the height adjustment element 42 in the screw-fitted state of the connection device 37 bear in a planar manner on the lower side of the drawer base 14.

Figure 9:
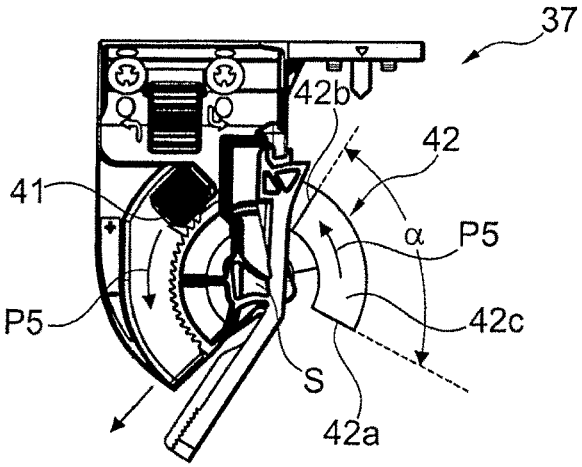
FIG. 9 shows the connection device according to FIG. 8 in a maximum position.

The operating element 41, the latching member 44, and the height adjustment element 42 are preferably formed so as to be integral, or form the separate actuator part 54 which is preferably plug-fittable to the main component 46 in a releasable manner. The actuator part 54 in a central portion that can be seen in FIG. 7 has an opening, for example, a split pin-type rotary bearing portion on the main component 46 reaching through the opening. The actuator part 54 is largely obscured in the figures; the actuator part 54 together with the entire height-adjustment element 42 being visible only in FIGS. 7 and 9.

The operating element 41 by way of an elastic member 41*a* (cf. FIG. 14) such as, for example, spring means such as a spring arm, is received so as to be movable in an elastic or sprung manner, respectively, in the directions P6 and P7 on the central portion of the actuator part 54. The operating element 41 by way of the spring means is pretensioned in a direction P6 such that the latching member 44 makes its way in a self-acting manner to a latching action with one of the latching teeth 43 and remains there as long as no external or manual action, respectively, is correspondingly exerted on the operating element 41. The latching action is self-locking by way of the spring force of the spring means, or of the elastically pretensioned member 41*a*, respectively. The operating element 41 by way of the elastic member 41*a* is offset in relation to the height adjustment element 42 by the spacing V in the axial direction of the rotation axis S.

The height adjustment element 42 on the main component 46 is pivotable or rotatable, respectively, in a reciprocating manner about a pivot axis or rotation axis S, respectively, in a manner limited by the detents 47 and 48, this being performed manually by an operator acting externally on the operating element 41. The rotation axis S is perpendicular to the plane of the upper side 37*a*.

The height adjustment element 42 that is attached to the central portion of the actuator part 54, or is present so as to be integral on the latter, respectively, is configured in the manner of a disk, preferably in the manner of an annular disk according to a divided ring. The divided ring according to the exemplary embodiment of the height adjustment element 42 illustrated has, for example, a radial width of approximately 10 millimeters at an external circumference of approximately 35 millimeters. The circumferential extent a of the divided ring, or of the height adjustment element 42 in relation to the rotation axis S is approx. 80 to 100 degrees, preferably approximately 90 degrees (cf. FIG. 9).

The height adjustment element 42 at a front free end 42*a* has a minimum thickness of, for example, zero to 0.1 millimeters, and at the other non-free end 42*b* thereof has a maximum thickness which is, for example, approximately 3 to 5, preferably approximately 4 millimeters.

The height adjustment element 42 in relation to the assembled use state has an upper side 42*c*, or on the upper side is preferably provided with a planar bearing edge, or a bearing edge that runs perpendicularly to the rotation axis S, respectively, and on the lower side is provided with a profile that is oblique in relation to the rotation axis S. The gradient of the thickness of the height adjustment element 42 is determined by an angle $\gamma$ which is preferably between approximately 5 and 9 degrees, preferably approximately 7 degrees (cf. FIG. 13). The variation of the thickness of the height adjustment element 42 is preferably performed so as to be stepless and/or preferably uniform. A wedge-type or ramp-type shape, respectively, of the height adjustment element 42 is thus provided.

Figure 8:
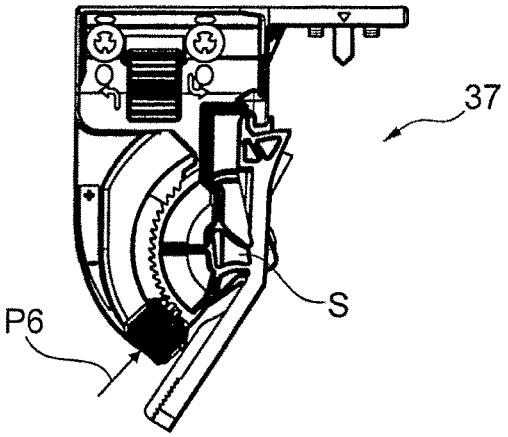
FIG. 8 shows the connection device according to FIG. 5 from below in a minimum position.
Figure 10:
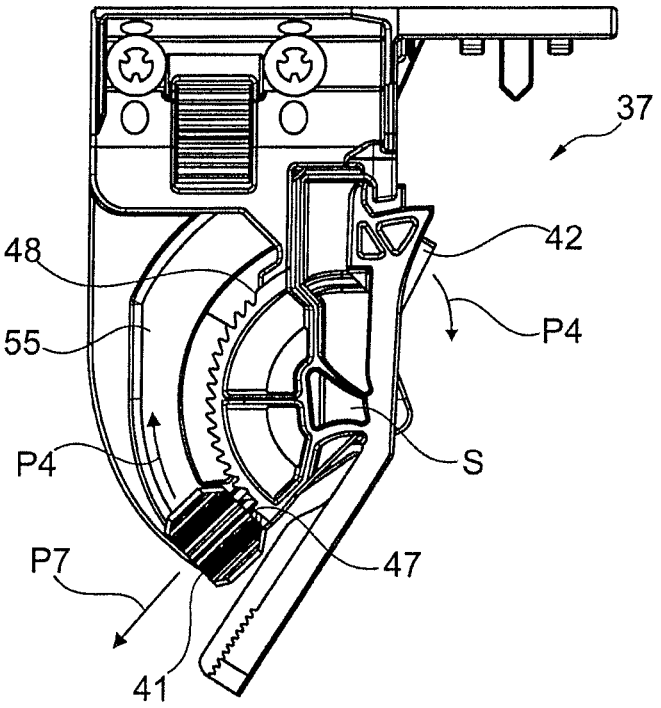
FIG. 10 shows the connection device according to FIG. 8 in an enlarged illustration.
Figure 11:
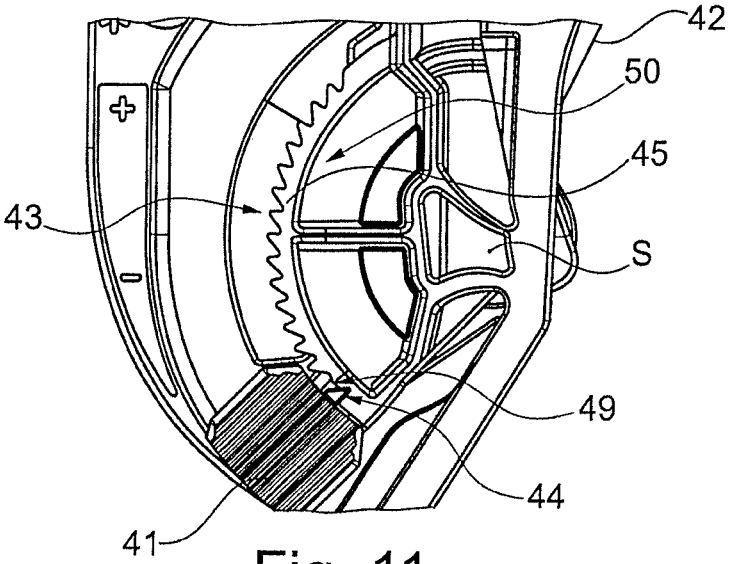
FIG. 11 shows an enlarged fragment from FIG. 10.

Proceeding from the minimum position of the connection device 37 according to FIG. 8 or FIG. 10, respectively, according to which the latching member 44 is latched in a self-locking manner on the latching teeth 43, and in the actuation direction P5 bears in a blocking manner (cf. FIG. 9) on the detent 47, the operating element 41 by way of manual action thereon is pushed outward in the direction P7. The latching member 44 herein exits the latching action and can then be rotated or adjusted, respectively, in the direction P4 about the rotation axis S, the height adjustment element 42 thus also being rotated in the direction P4. This adjustment movement can be performed at maximum to the terminal or maximum position, respectively, of the connection device 37 according to FIG. 9, the latching member 44 in the terminal or maximum position, respectively, mechanically bearing on the detent 48 and being blocked by the latter. Depending on the adjustment path travelled by the operating element 41, the height adjustment element 42 is rotated outward by a corresponding distance in the direction P4. The height adjustment element 42 herein, by way of the free end 42*a* thereof, pushes or forces, respectively, itself ahead between the lower side of the drawer base 14 and the upper side 19*a* of the sliding element rail 19. The height adjustment of the drawer 3 relative to the guide rail 19 and thus to the furniture cabinet unit 2 takes place herein, this being highlighted by FIGS. 13 and 14.

Figure 13:
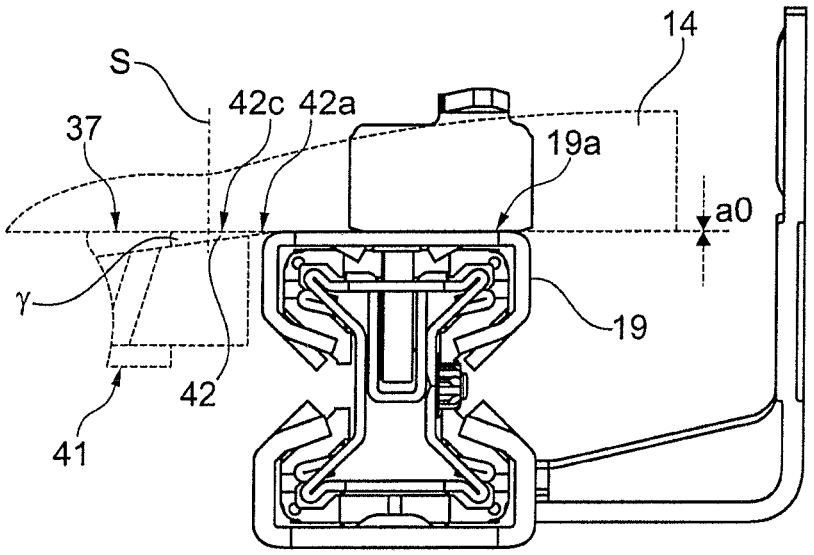
FIG. 13 shows an end view of the guide system according to FIG. 7 without an intermediate piece, having indicated portions of the sliding element and of the connection device in the minimum position of the latter.
Figure 14:
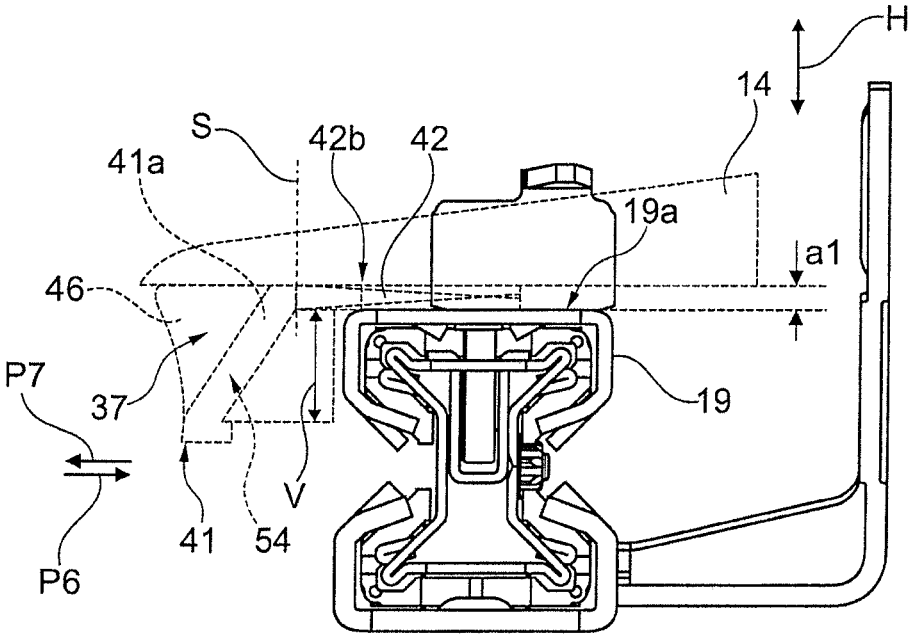
FIG. 14 shows the assembly according to the view as per FIG. 13 in a maximum position of the connection device.

FIGS. 13 and 14 show the connection device 37 and the drawer base 14 only in fragments and in schematic contours and indicated by dashed lines.

FIG. 13 shows the minimum position of the connection device 37 according to FIG. 8, wherein a minute spacing a0 of zero millimeters is established between the lower side of the drawer base 14 and the upper side 19*a* of the sliding element rail 19. The drawer base 14 is accordingly supported directly on the sliding element rail 19. The height adjustment element 42 on the connection device 37 is pivoted completely back in the direction P5 and therefore does not engage between the lower side of the drawer base 14 and the upper side 19*a* of the sliding element rail 19. In the vertical direction, or in the height direction H, respectively, (cf. FIG. 14), the drawer 3 according to FIG. 13 is located at a lowermost height position on the furniture cabinet unit 2, or on the item of furniture 1, respectively.

By adjusting the height adjustment element 42 by pressing the operating element 41 in the direction P7 and sliding the operating element 41 in the direction P4, wherein the latching member 44 is released from the latching action with the latching teeth 43, the height adjustment element 42 is rotated in the direction P4 and by way of the portions thereof in which the thickness increases from the free end 42*a* to the end 42*b* slides between the lower side of the drawer base 14 and the upper side 19*a* of the sliding element rail 19. A maximum spacing al between the lower side of the drawer base 14 and the upper side 19*a* of the sliding element rail 19 of, for example, 4 millimeters is reached in the maximum position, when the latching member 44 bears on the detent 48. In the vertical direction, or in the height direction H, respectively, the drawer 3 is located in an uppermost height position on the furniture cabinet unit 2, or on the item of furniture 1.

A corresponding intermediate height position becomes capable of being set in all of the potential rotated intermediate positions of the height adjustment element 42, having a spacing a between the minimum spacing a0 and the maximum spacing al between the lower side of the drawer base 14 and the upper side 19*a* of the sliding element rail 19.

The securing of the latching member 44 in an actuated position by way of the latching action of the latching member 44 on the respective portion along the row of the latching teeth 43 is implemented in a self-acting manner by releasing the compressive action on the operating element 41 on account of the sprung pretension on the latching member 44 in the direction P6 by way of the elastic member 41*a*, or the spring arm, respectively, on which the operating element 41 is received in a sprung and resettable deflectable manner.

The latching teeth 43 are preferably disposed along the shell face 45, or a conical face, respectively, or a conical shell face, respectively. The associated part-cone 50 that is shaped on the main component 46 is designed, for example, as a truncated cone that in relation to the cone axis is circumferentially delimited to approximately 90 degrees, the latching teeth 43 on the shell face 45 of the truncated cone being present so as to be aligned in a mutually parallel manner. The cone axis of the associated truncated cone preferably coincides with the rotation axis S. The conical shell face of the part-truncated-cone contracts in the direction toward the upper side 37 of the connection device 37. An intensity of the latching effect of the latching member 44 with the latching teeth 43 can be influenced by way of the length of the latching teeth 43, for example.

The latching member 44 in the minimum position establishes a latching connection with a first latching tooth which is designed as the retaining tooth 49 and in the direction P4 is positioned at the first position in the row of the latching teeth 43. The detent 47 is formed so as to neighbor the retaining tooth 49 in the direction P5. The retaining tooth 49 has tooth flanks which converge toward the tip of the retaining tooth 49 and which in relation to a direction radial to the rotation axis S preferably have a smaller angle than the flanks of the respective remaining latching teeth 43. A resistance to unlatching the latching member 44 from the latching action on the retaining tooth 49 is thus comparatively increased as compared to a resistance for unlatching the latching member 44 from the latching action with one of the remaining teeth 43 which are preferably mutually the same or identical, respectively, having flanks of the respective latching teeth 43 that are preferably shaped in a mutually identical manner. The more intense latching effect of the latching member 44 on the retaining tooth 49 is advantageous, in particular, to the minimal or transportation position, respectively, of the connection device 37 that is illustrated in FIG. 10.

Figure 12:
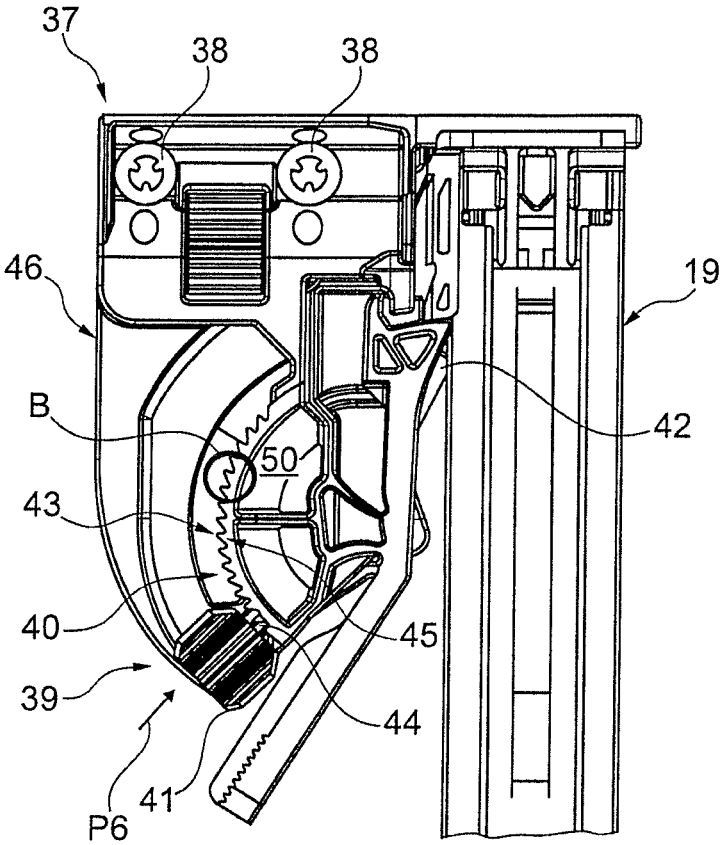
FIG. 12 shows the fragment according to the region A in FIG. 5, without portions of the sliding element.
Figure 12A:
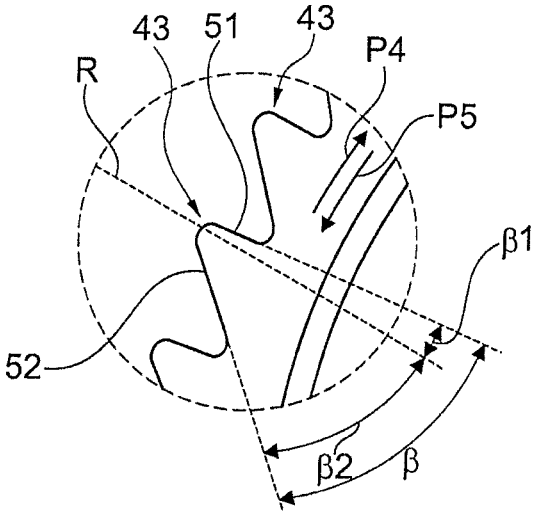
FIG. 12*a* shows the enlarged fragment according to the region B in FIG. 12.

Each of the latching teeth 43 has two opposite latching flanks, or latching faces 51 and 52, respectively (cf. FIG. 12*a*), wherein the latching faces 51 and 52 enclose a latching angle β, wherein the latching angles β of all of the latching teeth 43 are preferably almost identical, for example, being approximately 40 to 60 degrees, in the exemplary embodiment illustrated being preferably approximately 50 degrees. The latching face 51 in relation to the radial R, which runs through the rotation axis S and the tip of a latching tooth 43, is angled at the angle β1, and the latching face 52 is angled at the angle β2 which is larger in relation to the angle β1. The angles β1 and β2 complement one another to form the latching angle β.

The latching face 51, when viewed in the adjustment direction P5, has a larger gradient, or is aligned so as to be steeper, respectively, than a gradient of the second latching face 52, when viewed in the adjustment direction P4, or the second latching face 52 is aligned so as to be flatter in relation to the direction P4, respectively.

LIST OF REFERENCE SIGNS

1 Item of furniture
2 Furniture cabinet unit
3 Drawer
4 Side wall
5 Side wall
5*a* Internal side
6 Rail full pullout
7 Rail full pullout
8 Rail full pullout
9 Rail full pullout
10 Drawer side wall
11 Drawer side wall
12 Front element
13 Rear wall
14 Drawer base
15 Cavity frame
15*a* Housing
15*b* Internal structure
16 Full pullout

17 Cabinet unit rail
18 Central rail
19 Sliding element rail
19*a* Upper side
19*b* Hook element
20 Carriage
20*a* Portion
20*b* Portion
21 Carriage
21*a* Portion
21*b* Portion
22 Motion mechanism
23 Horizontal wall portion
24 Horizontal wall portion
25 Side wall portion
26 Side wall portion
27 Side wall portion
28 Side wall portion
29 Weld seam
30 Sliding direction
31 Rail member
32 Pin
33 Fastening element
34 Fastening element
35 Detent
36 Detent
37 Connection device
37*a* Upper side
38 Screw
39 Adjustment means
40 Latching means
41 Operating element
41*a* Member
42 Height adjustment element
42*a* End
42*b* End
42*c* Upper side
43 Latching tooth
44 Latching member
45 Shell face
46 Main component
47 Detent
48 Detent
49 Retaining tooth
50 Part-cone
51 Latching face
52 Latching face
53 Rotary mounting
54 Actuator component
55 Clearance

The invention claimed is:

1. A device, the device configured to connect a movable sliding element of an item of furniture to a guide rail of a guide system of the item of furniture, or configured to connect a movable sliding element of a domestic appliance, to a guide rail of a guide system of the domestic appliance, wherein the device comprises a main component and a height adjustment element, which has a ramp shape that extends from a minimum height position to a maximum height position, wherein the height adjustment element is configured to be pivotable, or rotatable, in a reciprocating manner about a pivot axis, or a rotation axis, along a stationary shell face of the main component, wherein an operating element, which comprises a projecting latching member, is connected to the height adjustment element, and the operating element is configured to be pretensioned in a latching direction extending towards a plurality of latching teeth, which are disposed along the stationary shell face of the main component, such that the latching member is configured to engage a detent between two immediately adjacent latching teeth of the plurality of latching teeth in a self-locking manner, wherein when the operating element is pushed in a direction opposite to the latching direction, the latching member is disengaged from the detent between the two immediately adjacent latching teeth of the plurality of latching teeth and the height adjustment element is configured to be pivoted, or rotated, wherein the height adjustment element is moved to a position either at or between the minimum height position and the maximum height position to cause a positional modification of the sliding element relative to the guide system, such that a spatial modification of the sliding element relative to the guide rail is achieved.

2. The device according to claim 1, wherein the height adjustment element, the operating element, and the latching member are configured so as to be integral.

3. The device according to claim 1, wherein the plurality of latching teeth are disposed along a conical face.

4. The device according to claim 1, wherein the plurality of latching teeth have latching faces, wherein the latching faces enclose a latching angle, wherein the latching angles of the plurality of latching teeth are identical.

5. The device according to claim 1, wherein the plurality of latching teeth comprise a retaining tooth, wherein the shape of the retaining tooth differs in each case from the shape of the remaining latching teeth.

6. The device according to claim 1, wherein the plurality of latching teeth are disposed beside one another in a row, wherein a retaining tooth in the row is disposed on an external side.

7. The device according to claim 1, wherein a first latching face of the plurality of latching teeth when viewed in a first adjustment direction of the latching member has a larger gradient than a gradient of a second latching face of the plurality of latching teeth when viewed in a second adjustment direction of the latching member.

8. The device according to claim 1, wherein the height adjustment element is present in the form of a circular disk, and wherein a thickness of the circular disk is configured so as to increase or decrease along a circular path about the rotation axis of the height adjustment element.

9. The device according to claim 8, wherein the circular disk is a divided circular disk.

10. The device according to claim 1, wherein the operating element has an elastic member, wherein the operating element is connected to the height adjustment element by way of the elastic member.

11. The device according to claim 1, wherein the operating element in relation to a surface of the height adjustment element is present so as to be offset in a direction of the rotation axis of the height adjustment element, wherein the operating element is movable relative to the rotation axis of the height adjustment element.

12. An item of furniture or domestic appliance having a device according to claim 1.

13. The device according to claim 1, wherein the height adjustment element is configured in the manner of a disk.

* * * * *